US008468857B2

(12) United States Patent
Nieh et al.

(10) Patent No.: US 8,468,857 B2
(45) Date of Patent: Jun. 25, 2013

(54) APPARATUS FOR DETERMINING LOAD SIZE IN A WASHING MACHINE

(75) Inventors: Jenn-Yeu Nieh, Saint Joseph, MI (US); Bennett James Cook, Watervliet, MI (US); James Andrew Oskins, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/549,716

(22) Filed: Jul. 16, 2012

(65) Prior Publication Data

US 2012/0279262 A1 Nov. 8, 2012

Related U.S. Application Data

(62) Division of application No. 12/182,201, filed on Jul. 30, 2008, now Pat. No. 8,245,342.

(51) Int. Cl.
*D06F 33/02* (2006.01)

(52) U.S. Cl.
USPC ..... 68/12.04; 68/12.05; 68/12.21; 68/23.5

(58) Field of Classification Search
USPC ..... 68/12.04, 12.05, 12.19, 12.21, 12.27, 68/23 R, 23.5
See application file for complete search history.

(56) References Cited

U.S. PATENT DOCUMENTS

| | | | | |
|---|---|---|---|---|
| 5,144,819 | A * | 9/1992 | Hiyama et al. | 68/12.04 |
| 5,768,729 | A * | 6/1998 | Cracraft | 8/158 |
| 6,247,339 | B1 * | 6/2001 | Kenjo et al. | 68/12.04 |
| 6,591,439 | B2 * | 7/2003 | Whah et al. | 8/159 |
| 2007/0119217 | A1 * | 5/2007 | Worthington | 68/158 |

* cited by examiner

*Primary Examiner* — Joseph L Perrin
(74) *Attorney, Agent, or Firm* — Clifton G. Green; McGarry Bair PC

(57) ABSTRACT

A method for determining the laundry load size according to one embodiment of the invention in an automatic clothes washer comprising supplying water to a reference water level to define a first amount of water, supplying water from the reference water level to a second water level above the reference water level and sufficient to submerge the laundry load to define a second amount of water, and determining a load size for the laundry load based on the second amount of water such that errors associated with the first amount of water are not considered in the load size determination based on the second amount of water.

4 Claims, 6 Drawing Sheets

APPARATUS FOR DETERMINING LOAD SIZE IN A WASHING MACHINE

CROSS REFERENCE TO RELATED APPLICATIONS

This application is a divisional of U.S. patent application Ser. No. 12/182,201, filed Jul. 30, 2008, which is hereby incorporated by reference.

BACKGROUND OF THE INVENTION

For a wash process of a washing machine, the water level in the tub may be set based on the size of a fabric load and, sometimes, the fabric type of the fabric load, if this information is available. The more cost effective solution from a cost of the washing machine perspective is to have the user manually input the fabric load information through a user interface; although from the perspective of convenience to the user, it may be desirable to have the washing machine automatically determine this. For manual input by the user, the user may oftentimes overestimate or underestimate the load size, thereby resulting in too much or too little water, respectively, for the wash process. Too much water is wasteful, and too little water may lead to an insufficient wash performance and/or other negative implications.

Many methods are known for the washing machine to automatically determine the load size and/or fabric type, such as by employing an output of the motor that drives the drum within the tub and the agitator within the drum. However, these systems depend on additional motor sensors, such as motor torque, and the associated hardware, such as multiple or variable speed motors, and their electronics, such as the motor controller, which naturally increase the cost of the machine. These associated additional costs are often unacceptable. Therefore, many machines have motors that do not provide output useful for determining load size or have other limitations that preclude or make undesirable known methods for automatically determining load size.

SUMMARY OF THE INVENTION

A method and apparatus for determining the laundry load size according to one embodiment of the invention in an automatic clothes washer comprising supplying water to a reference water level to define a first amount of water, supplying water from the reference water level to a second water level above the reference water level and sufficient to submerge the laundry load to define a second amount of water, and determining a load size for the laundry load based on the second amount of water such that errors associated with the first amount of water are not considered in the load size determination based on the second amount of water.

DESCRIPTION OF EMBODIMENTS OF THE INVENTION

Figure 1:
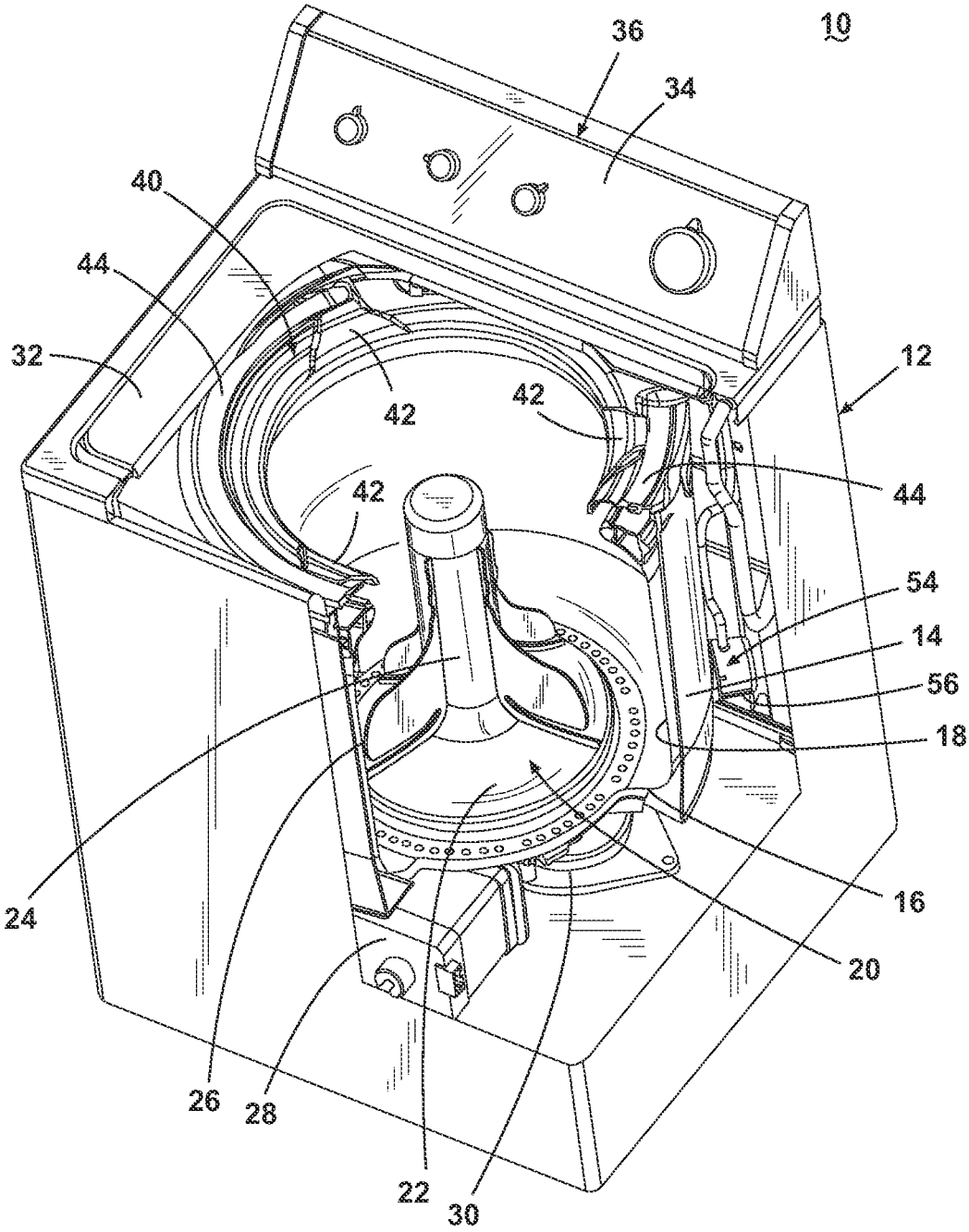
FIG. 1 is a front-top perspective view of an exemplary washing machine according to one embodiment of the invention with a portion cut-away to show interior components of the washing machine.

Referring now to the figures, FIG. 1 is a schematic view of an exemplary washing machine 10 according to one embodiment of the invention. The methods described herein may be used with any suitable washing machine and are not limited to use with the washing machine 10 described below and shown in the drawings. The washing machine 10 is described and shown for illustrative purposes. While the washing machine 10 is a top-fill washing machine having a vertical axis of rotation, the invention may have applicability in washing machines with different water filling systems and a different axis of rotation.

The washing machine 10 may include a cabinet or housing 12, an imperforate tub 14 having a sump 16, a perforated basket or drum 18 mounted within and rotatable relative to the tub 14 and defining a laundry chamber for receiving a laundry load, and an agitator 20 mounted within and rotatable relative to and/or with the basket 16. The exemplary agitator 20 may have a lower circular base or skirt portion 22, a central shaft 24 extending upwardly from the base 22, and a plurality of vanes or blades 26 spaced around and extending radially from the central shaft 24 with the lower edge of each blade 26 spaced above the base 22. A variety of other designs for the agitator 20 may also be used, or the agitator 20 may be omitted altogether without affecting the scope of the invention. The basket 18 and/or the agitator 20 may be driven by an electrical motor 28 operably connected via a transmission 30 to the basket 18 and/or the agitator 20. The transmission 30 may be a gear driven direct drive. The motor may be an induction motor, which may be coupled to the transmission 30. Other motors, such as brushless permanent magnet (BPM) or a permanent split capacitor (PSC) motor may be used. Similarly, drive systems, other than a transmission 30, may be used, illustrative examples of which include direct drives or belt drives. A selectively openable lid 32 may be provided on the top of the cabinet 12 to provide access into the basket 18 through the open top of the basket 18. A user interface 34, which may be located on a console 36, may include one or more knobs, switches, displays, and the like for communicating with the user, such as to receive input and provide output.

A spraying system 40 may be provided to spray liquid, such as water or a combination of water and one or more wash aids, such as detergent, into the open top of the basket 18 and onto the top of any fabric or laundry load placed within the basket 18. The spraying system 40 may be configured to supply water directly from a household water supply and/or from the tub 14 and spray it onto the fabric load. The spraying system 40 may also be configured to recirculate liquid from the tub 14, including the sump 16 in the tub 14, and spray it onto the top of the fabric load. Other embodiments of the invention may use other water delivery techniques known to those skilled in the art. As used herein, the terms water and liquid are interchangeable and may refer to water or a combination of water and wash aid, including detergents, bleaches, and other wash or rinse aids.

As illustrated, the spraying system 40 may have one or more spray heads 42 directed into the open top of the basket 18. A liquid supply line (not shown) supplies liquid to a distribution manifold 44 integrated with the balancing ring to effect the supply of liquid to the spray heads 42. The supply line may be fluidly coupled to either or both of the household water supply or the tub 14 as previously described. When liquid is supplied to the supply line from either the household supply or the tub 14, the liquid may be directed to the spray heads 42 through the manifold 44 and then be emitted through the spray heads 42 into the open top of the basket 18 and onto any fabric load in the basket 18.

If the number, location, and coverage of the spray heads 42 is insufficient to substantially cover the basket 18, the basket may be rotated so that the fabric load is rotated beneath the spray heads 42 for a more even wetting. However, the number of spray heads 42 and their location may be selected to control their spray coverage such that they sufficiently evenly wet the fabric load in the basket 18 without the need for rotating the basket 18, which likely reduces the cost and complexity of the motor 28, the transmission 30, and a controller 60.

Figure 2:
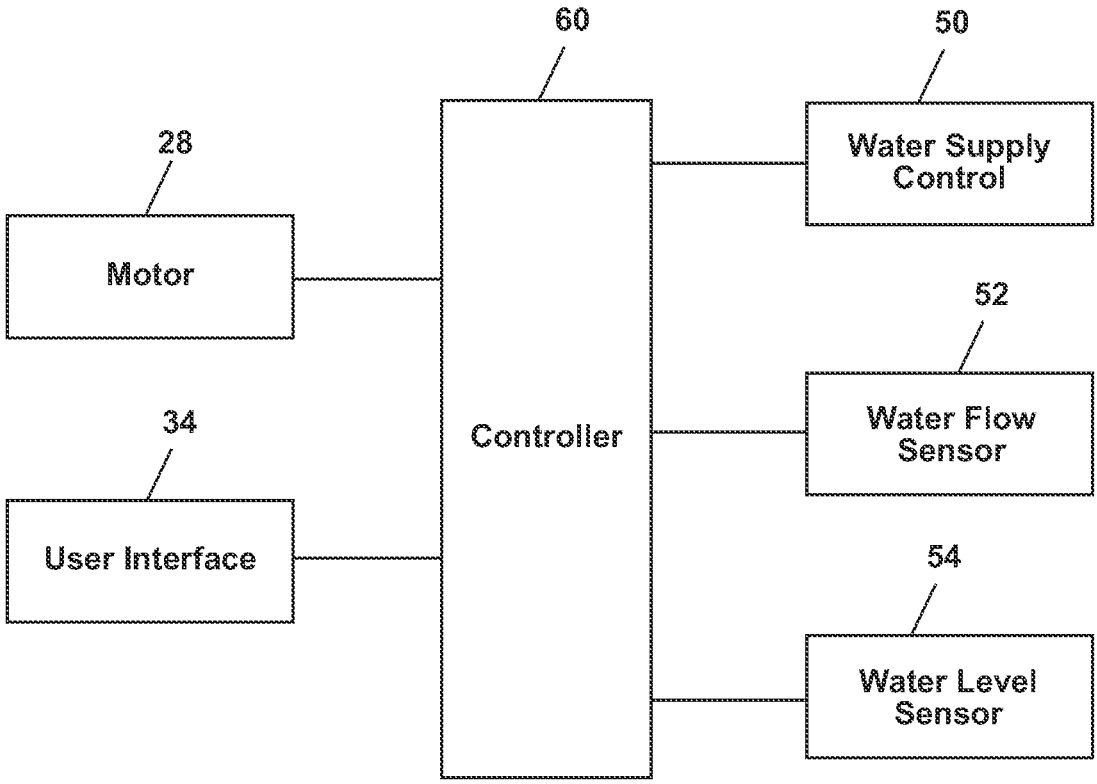
FIG. 2 is a schematic view of a control system for the washing machine of FIG. 1 according to one embodiment of the invention.

Referring now to FIG. 2, in one embodiment of the invention, the washing machine 10 further includes a water supply control 50, a water flow sensor 52, and a water level sensor 54. The water supply control 50 may include one or more valves, pumps, and/or other flow control devices operable to selectively fluidly communicate an external water supply (not shown) with the tub 14 or the spraying system 40. The water flow sensor 52 may be employed to measure the amount of water supplied to the tub 14, including water supplied via the spraying system 40. The water flow sensor 52 may measure the amount of supplied water directly, such as a flow meter, or indirectly, such as by monitoring the open and closed durations of one or more water valves or the operation of other devices in the water supply control 50.

When the water supply control 50 controls the supply of water to the tub 14, the level of water in the tub 14 may be detected by the water level sensor 54, which may be positioned in any suitable location for detection of the water level in the tub 14. The water level sensor 54 may be any suitable type of water level sensor, such as a pressure sensor, including a dome-type pressure sensor or a float-type sensor, as is well-known in the art and illustrated in the drawings.

Figure 3:
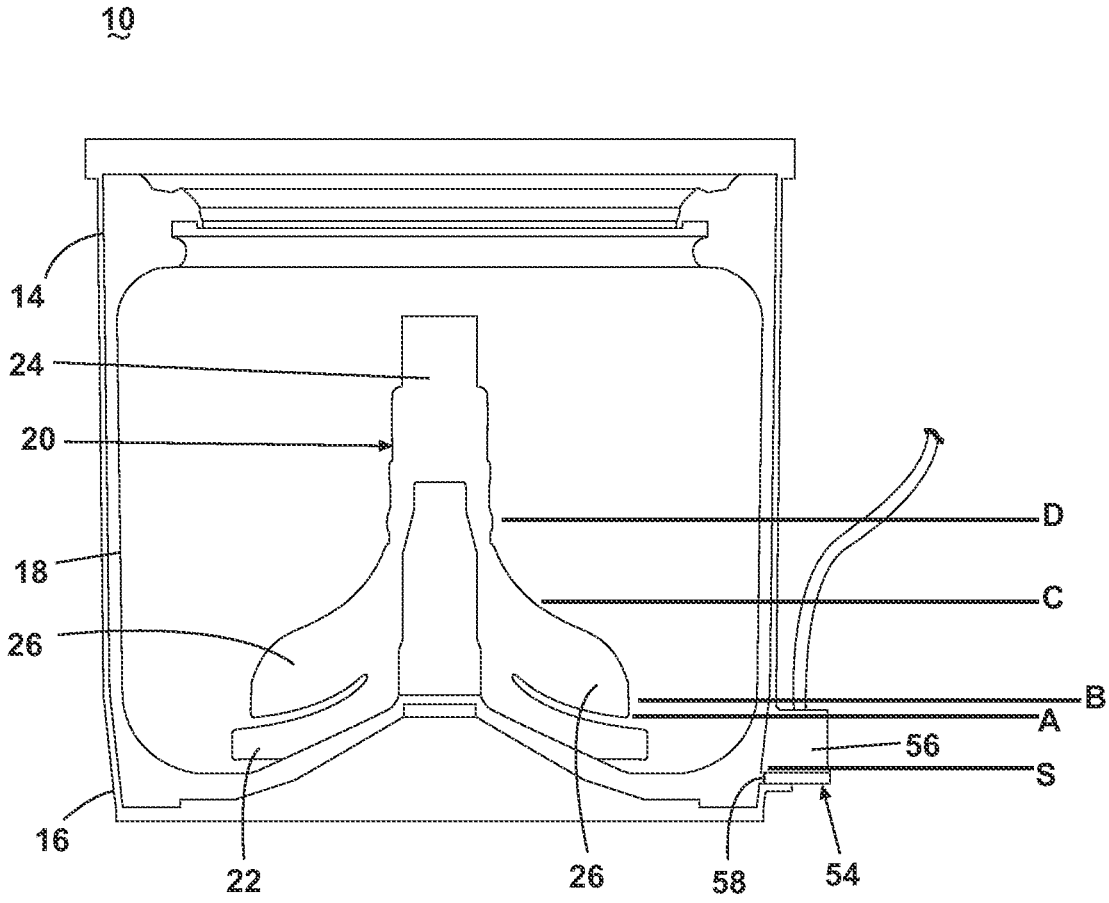
FIG. 3 is a schematic view of the washing machine of FIG. 1 illustrating preset water levels S, A, B, C, and D according to one embodiment of the invention.

In the embodiment illustrated in FIG. 1, the water level sensor 54 is positioned adjacent to the sump 16 of the tub 14. In particular, as best seen in FIG. 3, which is schematic view of the washing machine tub 14, basket 18, agitator 20, and water level sensor 54 of FIG. 1, the water level sensor 54 may be a dome-type pressure sensor including a housing 56 mounted to the outside of the tub 14 and fluidly coupled with the inside of the tub 14, particularly the sump 16, through an opening or inlet 58. Water from the inside of the tub 14 is exposed to the water level sensor 54 through the inlet 58 into the housing 56. The water level sensor 54 "sees" the pressure associated with the water in the tub acting at the inlet 58, as is well-known in the art. Thus, the water level in the tub 14 must be at least as high as the inlet 58 for the water level sensor 54 to be able to detect the presence of water in the tub 14, which will be described in more detail below.

Referring back to FIG. 2, the controller 60 communicates with several working components and/or sensors in the washing machine 10, such as the motor 28, the user interface 34, the water supply control 50, the water flow sensor 52, and the water level sensor 54, to receive data from one or more of the working components or sensors and may provide commands, which may be based on the received data, to one or more of the working components to execute a desired operation of the washing machine 10. The commands may be data and/or an electrical signal without data. Many known types of controllers may be used for the controller 60. The specific type of controller is not germane to the invention.

The washing machine 10 shown in the figures and described herein is a vertical axis washing machine. As used herein, the "vertical axis" washing machine refers to a washing machine having a rotatable drum that rotates about a generally vertical axis relative to a surface that supports the washing machine. However, the rotational axis need not be vertical; the drum may rotate about an axis inclined relative to the vertical axis. Typically, the drum is perforate or imperforate and holds fabric items and a fabric moving element, such as an agitator, impeller, pulsator, infuser, nutator, and ribbing or baffles on the interior wall of the basket or drum, and the like, that induces movement of the fabric items to impart mechanical energy directly to the fabric articles or indirectly through wash water in the drum for cleaning action. The clothes mover is typically moved in a reciprocating rotational movement, although non-reciprocating movement is also possible.

Although the washing machine 10 is a vertical axis washing machine, the methods described below may be employed in any suitable washing machine having a fabric moving element, including washing machines other than vertical axis washing machines. As used herein, "agitator" refers to any type of fabric moving element and is not limited to the structure commonly associated with an agitator, such as the structure shown in FIG. 1. Similarly, "agitate" refers to moving the fabric items and/or the water, regardless of the type of fabric mover inducing the movement of the fabric items and the type of motion of the fabric mover to induce the movement.

A washing machine may perform one or more manual or automatic operation cycles, and a common operation cycle includes a wash process, a rinse process, and a spin extraction process. Other processes for operation cycles include, but are not limited to, intermediate extraction processes, such as between the wash and rinse processes, and a pre-wash process preceding the wash process, and some operation cycles include only a select one or more of these exemplary processes. Regardless of the processes employed in the operation cycle, the methods described below may relate to determining a size of the fabric load for a process in the operation cycle.

As illustrated, the motor 28 and transmission 30, while economical and functional, are not capable of more advanced load size determination methodologies, such as inertia determination based on motor torque data obtained from the motor current. The motor control provides for only a single speed of operation for the motor 28. There is mechanical noise from the clutch and brake that would interfere with such a control. There is no feedback from the motor power signal. The drain pump is also driven by the motor 28, which will cause pump draining when the basket is spun. For this type of configuration, other load size methods must be used, especially something other than relying on the motor torque signal.

Figure 4:
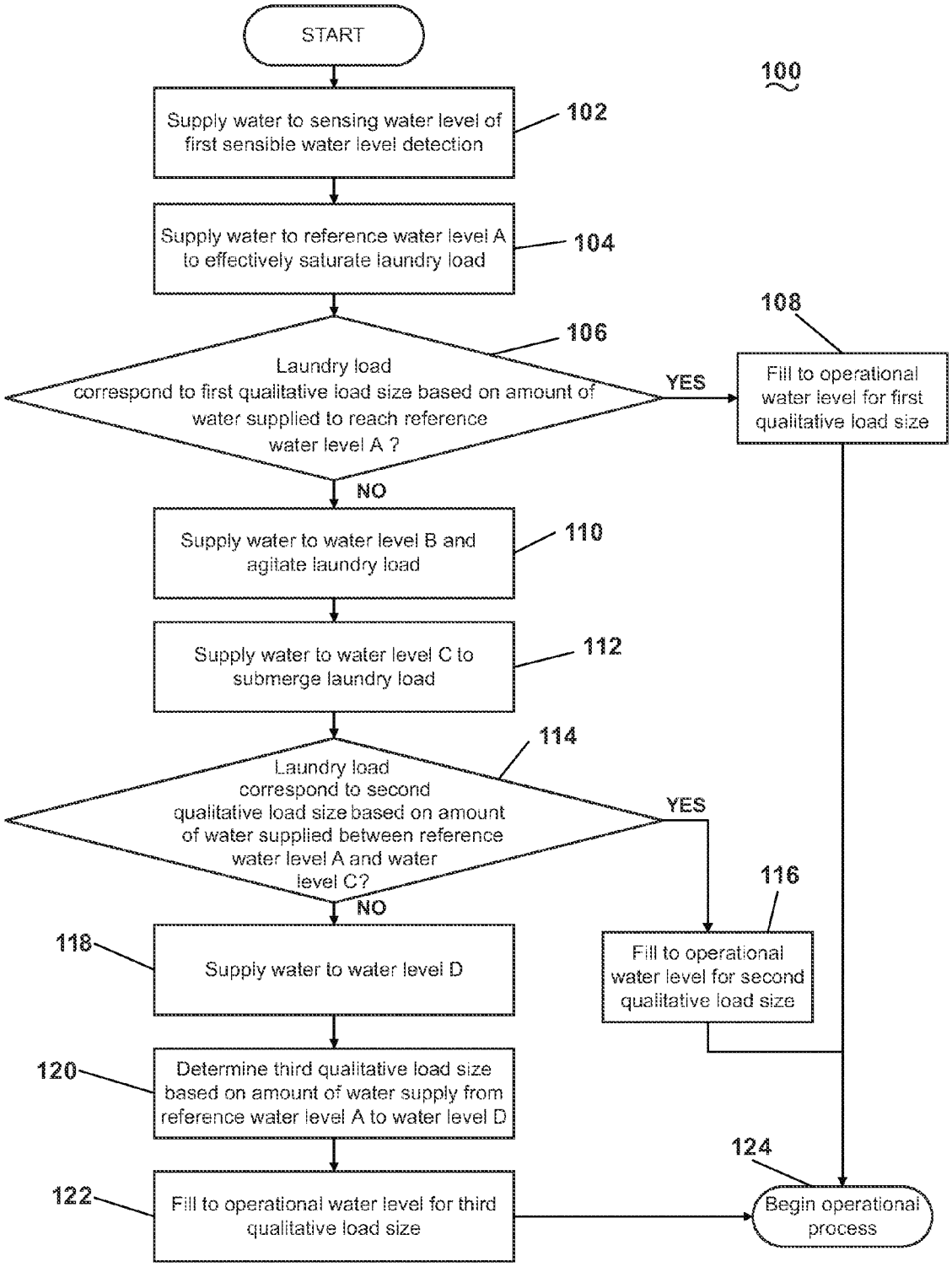
FIG. 4 is an exemplary flow chart of a method for determining load size in the washing machine of FIG. 1 according to one embodiment of the invention.

FIG. 4 provides a flow chart corresponding to a method 100 of operating the washing machine 10 according to one embodiment of the invention. The method 100 may be implemented in any suitable manner, such as in an automatic or manual operation cycle of the washing machine 10. The method 100 may be conducted as part of a wash process or other suitable process, such as a pre-wash or rinse process, of the operation cycle. Regardless of the implementation of the method 100, the method 100 may be employed to determine a size of the fabric load for the associated process, which will be described as the wash process hereinafter for illustrative purposes.

In general, the method 100 may employ the water level sensor 54 and the water flow sensor 52 during supply of water to the tub 14 to determine laundry load size. The water supply control 50 supplies water to preset water levels in the tub 14, which may be detected by the water level sensor 54, and the water flow sensor 52 determines the amount of water actually supplied to the tub 14 to reach the preset water levels. The amounts of water supplied to reach each of the preset water levels may be employed to determine the laundry load size. According to one embodiment of the invention, the preset water levels may be selected according to water absorption and displacement behavior of the laundry load, as will be described in more detail below.

The flow chart in FIG. 4 provides an overview of the method 100 according to one embodiment of the invention. The method 100 will be described according to the steps shown in FIG. 4 with reference to the schematic illustration of the washing machine in FIG. 3. The steps illustrated in FIG. 4 illustrate one manner in which the method 100 may be implemented. For purposes of the invention, it is possible to have more or fewer steps, to combines steps, or have a different arrangement of the steps. Therefore, the specific steps and their sequence should not be considered limiting on the invention.

Prior to examining the specific steps in the method 100, the general approach of the method will be described for ease of understanding the specific example. The method 100 determines a qualitative or relative load size based on the amount of supplied water and the resulting water level in the tub 14. However, there may not be correspondence between the amount of supplied water and the resulting water level because of a variety of sources of error. The supplied water rarely results in a corresponding increase in the water level, that is, a one-to-one relationship between volume of supplied water and volumetric increase of the water level in the tub 14, until the clothes load is fully saturated and any interstitial spaces between the clothes items are filled with water. The method 100 takes into account many of the sources of error, especially those errors that are great enough to affect the load size determination.

One source of error is variation in the absorbency of the clothes load. Different clothes have different water absorption characteristics. For example, cottons will absorb more water than most synthetics. Therefore, the synthetic type load generally may have the tendency to be classified as smaller load size comparing to the same weight of cotton type load based on absorption method. In some cases, depending on the fabric mix, a smaller load of highly absorbent fabrics may absorb more than a larger load of less absorbent fabrics.

One source of error is the height of the inlet 58 respective to the sump bottom due to the manufacturing process variation, which will affect the relationship between the amount of supplied water and the resulting water level. The higher the position of the inlet 58, the more water will be needed to satisfy the set water level.

The physical setup and operation of the washing machine 10 may also introduce error into the relationship between the amount of supplied water and the resulting water level. In a properly working and properly level machine, a known amount of water is required to raise the water level to a sensing water level S (FIG. 3), which is the first level than can be sensed by the particular water level sensor 54. If the washing machine is not level, that is, the machine "tips" in one direction, the direction of the tipping will result in more or less water than what should be required to reach the sensing water level S. Improper leveling of the washing machine and mis-aligned or aging tub suspension are exemplary causes of an improper leveling.

Another source of error may be residual water in the sump. Under normal operation, a drain pump, which is normally located in the sump 16, will drain most to all of the water from the sump 16 after the completion of an operational cycle. However, not all washing machines drain all of the water either purposefully or accidentally. For example, an improperly working or installed drain pump will often leave some residual water in the sump. The residual water will cause the water level to reach the sensing water level sooner than it would if the water was completely drained, which tends to cause an underestimation of the load size when using a water supply and resulting water level method.

All of these sources of error can be thought of as "noise" in the system related to the accuracy of the water level seen by the water level sensor 54. Additional noise can come from the quality of the signal from the water level sensor 54 to the controller 60. The method 100 addresses many of these sources of noise in the system such that the amount of water supplied and its resulting level may be used to accurately determine clothes load size.

The method 100 begins with a step 102 of supplying water to the tub 14, such as via the spraying system 40, to the sensing water level S, which may be a level of water corresponding to a first sensible or meaningful water level that can be sensed by the water level sensor 54. As mentioned above, in the configuration of washing machine 10 of FIG. 3, the water level sensor 54 is unable to detect a water level for water present in the tub 14 below the inlet 58 to the water level sensor 54; therefore, if not already present, water must be supplied to at least the inlet 58 before the water level sensor 54 can determine the water level.

Thus, the actual water level corresponding to the sensing water level S may vary depending on the washing machine configuration and the type and location of the water level sensor 54 and may even vary for different operational cycles on the same washing machine. In the configuration of the washing machine 10 in the figures, the sensing water level S is a water level positioned in the sump 16 of the tub 14 at or above the inlet 58 to the water level sensor 54, as illustrated in FIG. 3.

Once the water reaches the sensing water level S, the water level sensor 54 is able to detect the water level in the tub 14, and the water supply continues at a step 104 to a reference water level A (FIG. 3). The water supply during the steps 102 and 104 may be continuous, or a pause may occur between the supply of water in the steps 102 and 104 such that the water supplies are discrete, which is true for all water supply steps in the method 100.

The reference water level A is at least higher than the sensing water level S and may be a water level sufficiently high such that the sump 16 is full. In the illustrated embodiment of FIG. 3, the reference water level A may be located above the base 22 of the agitator 20 and at or below the bottom of the agitator blades 26, which is about 56 mm (2.2 in.) above the inlet 58 to the water level sensor 54. Regardless of the particular location relative to the agitator 20, the reference water level A may be at least higher than a water level corresponding to any residual water that may be remaining in the sump from a previous operation of the washing machine 10.

Furthermore, the water level A may be selected such that when the water reaches the reference water level A, the laundry load in the basket 18 may have absorbed an amount of water at or near a maximum limit of absorption for the laundry load. In other words, the laundry load may be fully saturated or nearly fully saturated whereby any additional amount of water that the laundry load is able to absorb is negligible compared to the total amount of water that the laundry load is capable of absorbing. This condition may be referred to as effectively saturated, which is when the laundry load is sufficiently saturated such that any more absorption will not substantially negatively impact the accuracy of the load size determination for the resolution of the system. At the reference water level A, some or all of the laundry load, depending on the size of the laundry load, may be located below the reference water level A. Effective saturation may occur even though some of the laundry load may be positioned above the reference water level A because the water supply to the tub 14 may be directed onto the laundry load in the basket 18, as described above.

Meanwhile, the water flow sensor 52 determines the amount of water supplied to the tub 14 to reach the reference water level A. As the water is supplied to the tub 14, the water not only begins to fill the tub 14 but is also absorbed by the laundry load in the basket 18. Thus, the total amount of water supplied to reach the reference water level A is a combination of water that fills the space in the tub below the reference water level A and the water absorbed by the laundry load. Because the space in the tub below the reference water level A is known and consistent among different laundry loads, the amount water needed to fill that space is consistent among different laundry loads. Variation in the amount of water amount of water supplied to the tub 14 to reach the reference water level A, therefore, may be attributed to the load size and fabric type according to absorbency characteristics of the laundry load, i.e., all other things being equal, a larger load absorbs more water than a smaller load and requires more water to reach the water level A. Thus, the method 100 employs the amount of water supplied to reach the reference water level A, which relates to the absorbency of the laundry load, to determine whether the laundry load corresponds to a first qualitative load size at a step 106. In practice, the time to reach water level A is particularly useful to determine if an extra large load is present because such a load will absorb almost all of the water introduced by this time.

The amount of water supplied to reach the reference water level A may be employed to determine an absorption value of the laundry load, and the load size may be determined, in turn, on the absorption value. The absorption value may be any value related to the absorbency of the fabric load and may simply be the amount of water supplied to reach the reference water level A, in which case, the load size may be determined directly from the amount of water supplied to reach the reference water level A, which may be determined by the water flow sensor 52. Alternatively, the amount of water supplied to reach the reference water level A may be manipulated in a desired manner to obtain the absorption value, which may then be employed to determine the load size. In cases where the water flow sensor 52 is a wheel that rotates in the flow of water, the number of rotations or "count" may be used as the absorption value, which is supplied to the controller 60, which looks up the count in a data table stored in the controller 60. The data table may include a count range for different qualitative load sizes and then match the actual count to the count range to make a load size determination. Different data tables may be provided for different fill levels.

At step 106, a first qualitative load size may be determined. The first qualitative load size references a first determination. In some cases a first qualitative load size involves selecting between different qualitative load sizes. For example, in the method 100, the first qualitative load size may comprise an extra small load size and an extra large load size because both of these qualitative load sizes may be determined or ruled out depending on the absorption value. The use of the absorbency characteristics of the laundry load during the water supply to the reference level A may be suited to determine whether the laundry load is extra small or extra large, i.e., relative extremes on a load size scale, as compared to load sizes between extra small and extra large because the load size may dominate at these extreme load sizes with respect to the absorption behavior such that the absorbency due to fabric type may become negligible. In other words, the relatively small amount of water absorbed by an extra small load size and the relatively large amount of water absorbed by an extra large load size may be sufficiently small and large, respectively, so as to readily identify the laundry load sizes as such without considering the effect of fabric type on the absorbency of the laundry load.

When the first qualitative load size comprises the extra small and extra large load sizes, the determination at the step 106 may be made by comparing the amount of water needed to reach the reference water level A to a preset and empirically determined extra small and extra large amounts of water, respectively. If the amount of supplied water is less than the preset extra small amount of water, then the load size may be determined to be extra small, and, similarly, if the amount of supplied water is greater than the preset extra large amount of water, then the load size may be determined to be extra large.

Optionally, the method 100 may also include an overflow protection process whereby the amount of water added during the water supply may be compared to a preset overflow water amount; if the amount of water reaches the overflow water amount without a corresponding detection of water level by the water level sensor 54, then the controller 60 may assume that an error has occurred, such as an error of the water flow sensor 54, and cease water supply.

If the laundry load corresponds to the first qualitative load size, then at a step 108, water may be supplied to an operational water level corresponding to the laundry load size, if the water level has not already achieved the operational water level. An operational water level may be a level corresponding to the volume of water used in the wash or other operational process for the determined load size. As an example, in one embodiment, an extra small load of about less than 1 pound may have an operational water level corresponding to about 10 gallons of water, and an extra large load of about greater than 17 pounds may have an operational water level corresponding to about 22 gallons of water. All exemplary load sizes provided herein have a fabric type of about 50% cotton and 50% polyester for exemplary purposes.

If the laundry load does not correspond to the first qualitative load size, then at a step 110, water is supplied to a water level B, which may be any suitable water level at or above the reference water level A. The water supply during the steps 104 and 110 may be continuous, or a pause may occur between the supply of water in the steps 104 and 110 such that the water supplies are discrete. Upon reaching the water level B, the agitator 20 rotates to agitate and move the laundry load in the drum 18. In one exemplary embodiment, the water level B may be just above, such as a few millimeters, the reference water level A, as indicated in FIG. 3. The agitation may occur for any desired duration and may include rotation of the agitator in one or two directions at any suitable speed and frequency, such as the speed and frequency used in a normal wash process. As an example, the agitation may occur for about 5 seconds; in another embodiment, the agitation may occur for about 10-30 seconds.

Figure 5:
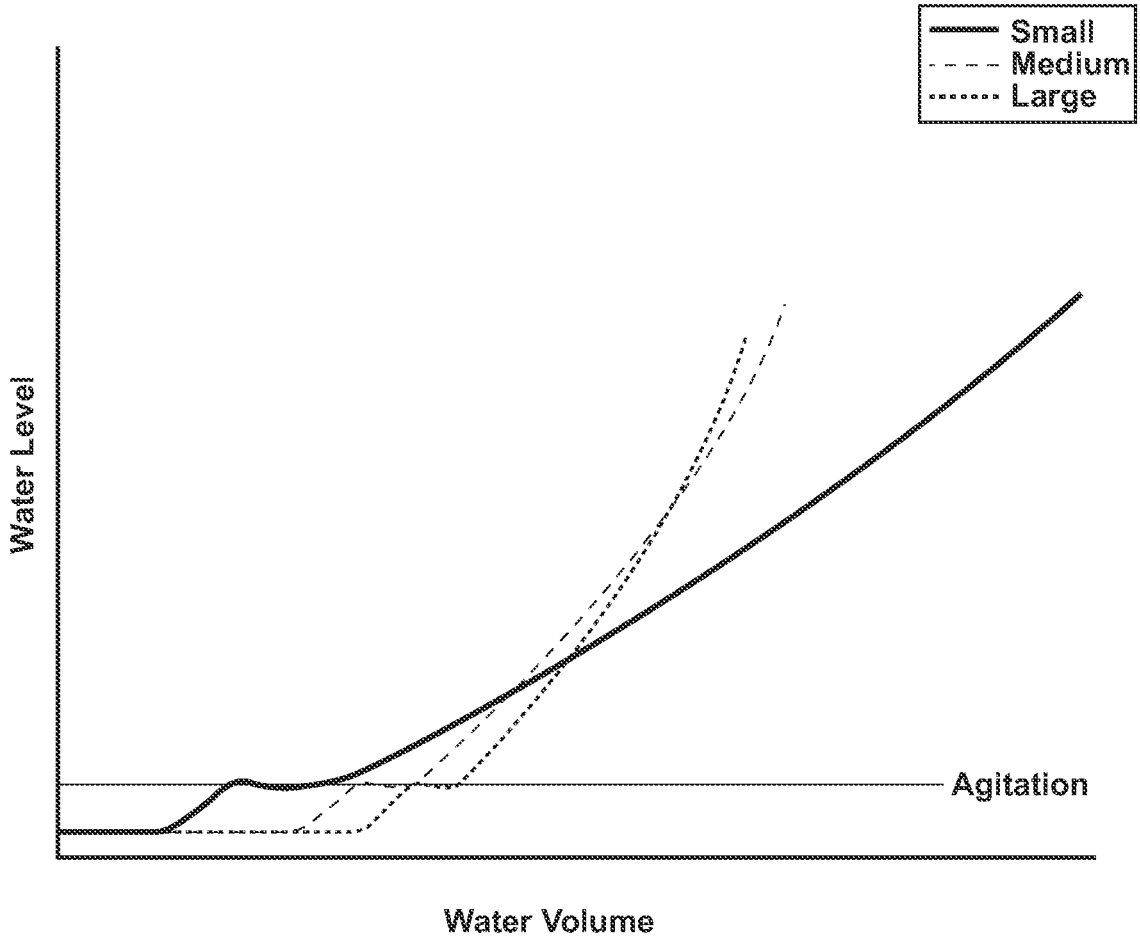
FIG. 5 is schematic illustration of water level as a function of water volume during water supply and showing the effect of agitation on water level according to the embodiment of FIG. 4.

Agitation of the laundry load typically facilitates a more even distribution of the individual fabric items in the laundry load. As the laundry moves in the basket 18, larger loads may be brought or pulled down into the water rather than forming a pile in the basket 18. The agitation helps to reduce variation by moving the fabric items to a more repeatable position. As shown in FIG. 5, which is a schematic graph of water level as a function of water volume for small, medium, and large load sizes, the water level typically undergoes a slight change during the agitation of the laundry load. The water level may rise slightly at the beginning of agitation before decreasing near the end of agitation. The initial rise may be due to the laundry load being pulled down into the water, thereby displacing the water level upward, and the subsequent decrease may result from the laundry load being distributed or spread throughout the bottom of the basket 18 and/or release of entrapped air in the laundry load.

Referring back to FIG. 4, water supply continues from the agitation water level B to a water level C in a step 112. The water supply during the steps 110 and 112 may be continuous, or a pause may occur between the supply of water in the steps 110 and 112 and during the agitation such that the water supplies are discrete. The water level C may be any suitable water level above the reference water level A, and, in the illustrated embodiment of FIG. 3, may be near the top of the agitator blades 26. In one embodiment, the water level C may be selected to submerge the laundry load in the water. As used herein, "submerge" means that all of the fabric items in the laundry load may be positioned below the top of the water and it may also be permissible that some of the fabric items, while being positioned below the top of the water, may partially project or extend above the top of the water. Further, while it may be assumed that the laundry load is effectively saturated upon reaching the reference water level A, any fabric items in the laundry load that are not fully saturated at the reference water level A are typically fully or completely saturated at the water level C. Complete saturation of the laundry load may be facilitated by the water supply directly on top of the laundry load via the spray heads 42.

During the supply of water from the reference water level A to the water level C, the laundry load displaces the water as it becomes submerged. In other words, because the laundry load is effectively saturated at the water level A, additional water supplied after the saturation goes to filling the space below the water level C in the tub 14 and the basket 18 except for the physical space occupied by the laundry load. Displacement refers to the physical space occupied by the laundry load (rather than the water) below the actual water level. A larger laundry load takes up more space than a smaller laundry load and displaces more water; therefore, a larger laundry load requires less water than a smaller laundry load to reach a given water level once the laundry is effectively saturated. The displacement caused by the laundry load, accordingly, may be employed as an indicator of load size.

In particular, the amount of water supplied to the tub 14 from the reference water level A to the water level C, which may be referred to as water amount A-C, may be employed to determine whether the laundry load corresponds to a second qualitative load size at a step 114. The second qualitative load size references a second determination. In one embodiment, the total amount of water supplied to reach the reference water level A may subtracted from the total amount of water supplied to reach the water level C to obtain the water amount A-C. Using the water amount A-C to determine load size provides several advantages. First, by subtracting or ignoring the amount of water supplied to reach the reference water level A, the load size determination at this step primarily relies upon the displacement caused by the laundry load as any absorption that occurs between the reference water level A and the water level C may be considered negligible. Second, water level sensing errors that may result from residual water in the sump 16 may be avoided because water supply below the reference level A, which is above water levels affected by such factors, is effectively canceled and not considered in the load size determination. By referring back to the water supply from the reference water level A rather than to the beginning of water supply, these errors may be effectively eliminated.

In one embodiment, for example, the water amount A-C may be employed to determine a displacement value of the laundry load, and the load size may be determined, in turn, based on the displacement value. The displacement value may be any value related to the displacement caused by the fabric load and may simply be the water amount A-C, in which case, the load size may be determined directly from the water amount A-C. The amount of water A-C may be determined from the water flow sensor 52 and, in the case of a rotating wheel flow rate sensor, may be the count of revolutions it took to raise the water level from A to C. Alternatively, the water amount A-C may be manipulated in a desired manner to obtain the displacement value, which may then be employed to determine the load size. For example, the count may be compared to a data table in the controller 60 to determine the load size or the count may be input to an algorithm in the controller 60 to determine the load size. As an example, the water amount A-C may be compared to a volume of the tub between the reference water level A and the water level C, which may be referred to as volume A-C. Because the volume A-C is fixed for a given washing machine and assuming that absorption is negligible (due to the laundry load being effectively saturated at or before the water level A), the difference between the volume A-C and the water amount A-C may be a volume attributable to the volume of the laundry load. The difference volume, or displacement value, may then be employed to determine the load size.

The second qualitative load size may be any suitable load size, and, continuing the example given above where the first qualitative load size comprises the extra small and extra large load sizes, the second qualitative load size may comprise a small load size. When the second qualitative load size comprises small load size, the determination at the step 114 may be made by comparing the water amount A-C to a preset and/or empirically determined amount of water. If the water amount A-C is greater than the preset amount of water (because smaller loads require more water to reach a given level), then the load size may be determined to be small or at least larger than the extra small load size.

Figure 6:
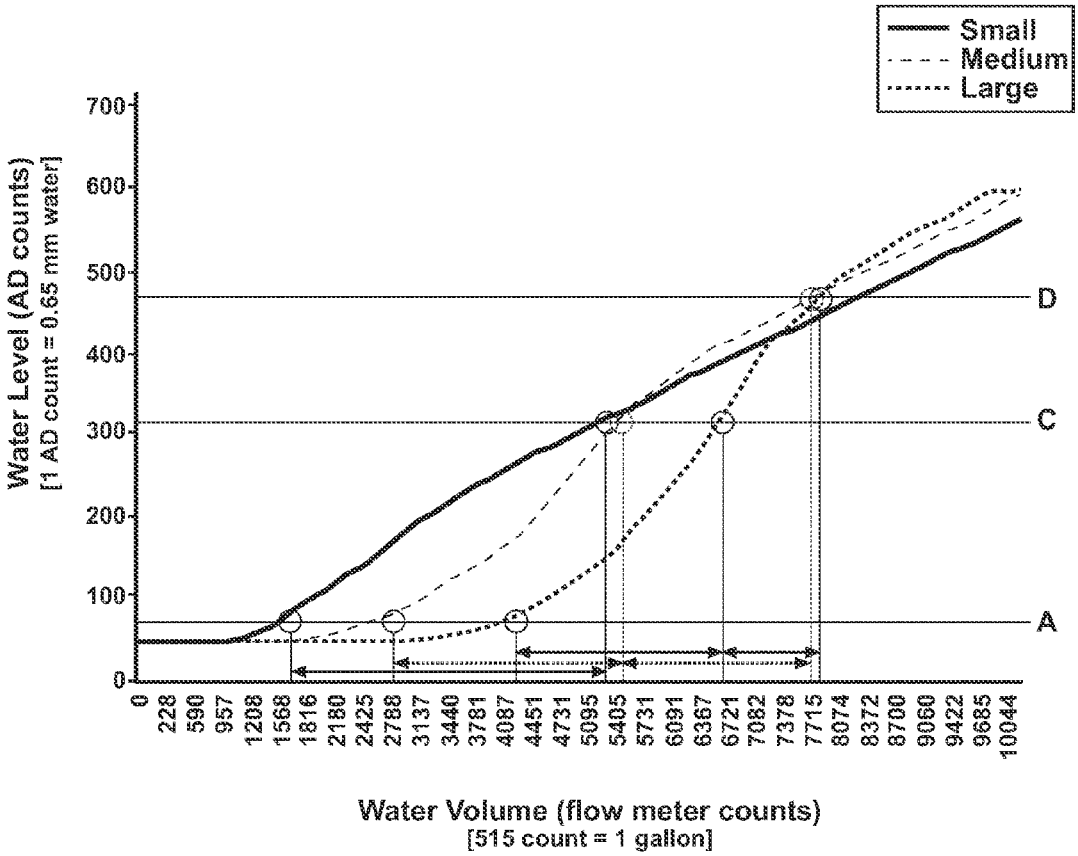
FIG. 6 is a graph of water level as a function of water volume during water supply to the preset water levels A, C, and D and showing displacement behavior of small, medium, and large size loads according to the method of FIG. 4 applied to the washing machine of FIG. 1.
Figure 7:
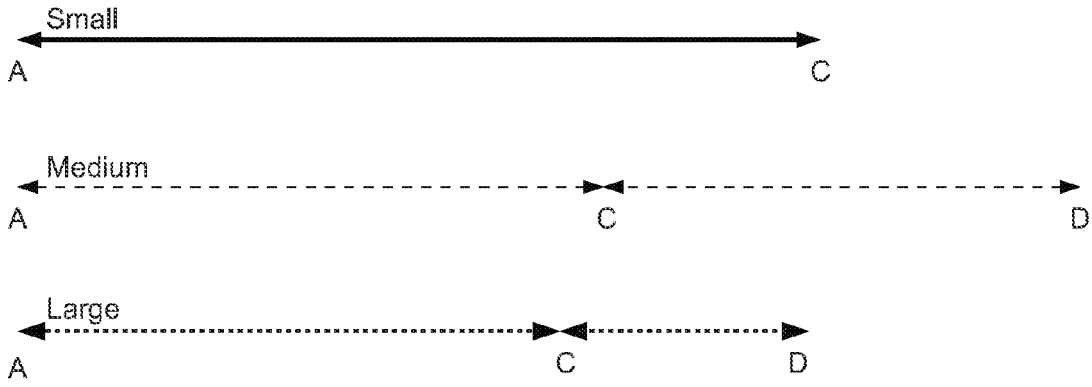
FIG. 7 is a line graph of the amount of water supplied between the water levels A and C and the water levels A and D for the small, medium, and large size loads taken from the graph of FIG. 6.

FIGS. 6 and 7 may be used to explain the underlying physical phenomena on which the second determination is based according to one embodiment of the invention. FIG. 6 is a graph of water level as a function of water volume or amount of supplied water for small, medium, and large laundry loads and illustrates the displacement behavior of the different load sizes during the water supply from the reference water level A to the water level C. The arrows at the lower portion of the graph depict one example of the water amounts A-C for the different load sizes, and one example of the water amounts A-C are reproduced to scale in FIG. 7 adjacent one another for ease of comparison. As can be seen in FIG. 7, the small load has a greater water amount A-C than the medium and large loads because smaller loads require more water to reach a given water level. Not only is the water amount A-C for the small load greater than that for the medium and large loads, but it is significantly larger than for the other loads such that the small load typically can easily be distinguished from the others by using the water amount A-C. The water amounts A-C for the medium and large loads are relatively close to each other such that differentiating the loads at the water level C may be difficult and inaccurate.

Referring back to FIG. 4, if the laundry load corresponds to the second qualitative load size, then at a step 116, water may be supplied to an operational water level corresponding to the laundry load size, if the water level has not already achieved the operational water level. As an example, in one embodiment, a small load of about 1-5 pounds may have an operational water level corresponding to about 11 gallons of water.

If the laundry load does not correspond to the second qualitative load size, which, in the example provided above, may be determined if the water amount A-C is not greater than the preset amount of water, then at a step 118, water is supplied to a water level D. The water supply during the steps 112 and 118 may be continuous, or a pause may occur between the supply of water in the steps 112 and 118 such that the water supplies are discrete. The water level D may be any desirable water level above the reference water level C, and, in the illustrated embodiment of FIG. 3, may be above the agitator blades 26 and along the central shaft 24. Because the water level D is above the water level C, the laundry load remains or becomes further submerged at the laundry level D. During the supply of water from the water level C to the water level D, the displacement due to the laundry load continues, and depending on the load size, the fabric items may float in the water such that they are free to move in the water and reside below the surface of the water. Because a larger laundry load takes up more space than a smaller laundry load, the floating behavior of the laundry load may occur at a lower water level for a smaller load than for a larger load. The floating behavior may occur at the water level C for laundry loads having the small load size and may be delayed until a level between the water levels C and D or until the water level D for larger loads.

Referring again to FIG. 4, the amount of water supplied to the tub 14 from the reference water level A to the water level D, which may be referred to as water amount A-D, may be employed to determine a third qualitative load size for the laundry load at a step 120. The third qualitative load size references a third determination. In one embodiment, the total amount of water supplied to reach the reference water level A may subtracted from the total amount of water supplied to reach the water level D to obtain the water amount A-D. Using the water amount A-D to determine load size provides similar advantages as described above for the using the water amount A-C at the step 114.

In one embodiment, for example, the water amount A-D may be employed to determine a displacement value of the laundry load, and the load size may be determined, in turn, based on the displacement value. The displacement value may be any value related to the displacement caused by the fabric load may simply be the water amount A-D, in which case, the load size may be determined directly from the water amount A-D. The amount of water A-D may be determined from the water flow sensor 52 and, in the case of a rotating wheel flow rate sensor, may be the count of revolutions it took to raise the water level from A to D. Alternatively, the water amount A-D may be manipulated in a desired manner to obtain the displacement value, which may then be employed to determine the load size. As an example, the water amount A-D may be compared to a volume of the tub between the reference water level A and the water level D, which may be referred to as volume A-D. Because the volume A-D is fixed for a given washing machine and assuming that absorption is negligible (due to the laundry load being effectively saturated at or before the water level A), the difference between the volume A-D and the water amount A-D may be a volume attributable to the volume of the laundry load. The difference volume, or displacement value, may then be employed to determine the load size.

The third qualitative load size determination, in one embodiment, may comprise selecting from multiple qualitative load sizes. Continuing the example provided above for the first and second qualitative load sizes, the third qualitative load size may comprise either a medium or a large load size. In another example, the system may have sufficient resolution at the step 114 for the third qualitative load size to comprise additional load sizes, such as two medium load sizes, a first medium load size and a second medium load size, rather than a single medium load size.

When the third qualitative load size comprises the first medium, second medium, and large load sizes, the determination at the step 120 may be made by comparing the water amount A-D to a series of decreasing (due to larger loads needing less water to reach a given level) preset and empirically determined amounts of water corresponding to the first medium, second medium, and large load sizes. If the water amount A-D is greater than the first medium preset amount of water, then the load size may be determined to be the first medium size; if the water amount A-D is less than the first medium preset amount of water and greater than the second medium preset amount of water, then the load size may be determined to be the second medium size; and if the water amount A-D is less than the second medium preset amount of water and greater than the large preset amount of water, then the load size may be determined to be the large size. Optionally, the third qualitative load size may also include an extra large load size in the case where the water amount A-D is outside the large load size range, i.e., the water amount A-D is less than the large preset amount of water.

Referring again to FIGS. 6 and 7, the medium load has a greater water amount A-D than the large load because smaller loads require more water to reach a given water level, and the difference between the water levels A-D for the medium and large loads is typically sufficiently significant so as to easily discern the medium load from the large load by using the water amount A-D.

Referring again to FIG. 4, following the determination of the third qualitative load size, water may be supplied to an operational water level corresponding to the laundry load size at a step 122, if the water level has not already achieved the operational water level. As an example, in one embodiment, a first medium load of about 5-8 pounds may have an operational water level corresponding to about 15 gallons of water, a second medium load of about 8-11 pounds may have an operational water level corresponding to about 16 gallons of water, and a large load of about 11-17 pounds may have an operational water level corresponding to about 18.5 gallons of water.

After determination of the load size in one of the steps 106, 114, and 120 and supply of water to the corresponding operational water level during one of the steps 108, 116, and 122, the process associated with the method 100 may begin or continue in any desired manner in a step 124.

Optionally, the amounts of water supplied to reach the various levels in the tub 14 (FIG. 3) may be employed to determine fabric type in addition to determining load size. In general, comparison between amounts of water indicative of the absorption and displacement characteristics of the fabric items in the laundry load may be used to determine the fabric type. As an example, after the load size has been determined, a ratio may be calculated as an inference of fabric type. In one example, the ratio may be a ratio of the amount of water supplied to reach the reference level A (i.e., indicative of absorption) to the water amount A-C (i.e., indicative of displacement), and a higher ratio corresponds to a more absorbent fabric type, such as a fabric type having a relatively higher cotton content as compared to polyester or other synthetic fabric content. Other ratios and other calculations, such as differences, and combinations thereof may be used to infer the fabric type.

The water levels A, B, C, and D are not limited to the particular levels illustrated in FIG. 3, and the levels shown in FIG. 3 are provided for illustrative and exemplary purposes. The water levels may vary for differing washing machines and may vary depending on the type of water supply system employed in a particular washing machine. For example, the water levels may vary depending on whether the water supply system is a spray-type system as described above (and depending on the type of spray system), a waterfall-type system where the water pours onto the laundry load, a system where the water is supplied directly to the sump 16, or other type of water supply system. As an example, effective saturation may occur at a different level than the water level A shown in FIG. 3 when the water supply system is a waterfall system as compared to a spray system. Further, the water levels may vary depending on other operational factors, such as whether the drum 18 rotates during the water supply to facilitate distribution of the water on the laundry load.

In the method 100, the operational water level may be set without a corresponding inference or determination of load size and vice-versa. It is possible that the method 100 may be employed only for setting the operational water level, in which case the inference of the load size may not be necessary. For example, in the steps 106, 114, and 120 of the exemplary method in FIG. 4, a determination of operational water level may be made instead of a determination of a qualitative load size, with a subsequent fill to the operational water level in the steps 108, 116, and 122. It is also contemplated that the method 100 may be employed for only determining the load size, and the inferred load size may thereafter be employed to determine other parameters for the operation cycle. It is also contemplated for the method 100 to both infer the load size and set the operational water level.

When the method 100 is employed for determining load size, the inferred load size may be a qualitative load size wherein the laundry load is assigned to a category, such as small, medium, and large, of load size based on the qualities of the laundry load. That is, the size of the load need not be weighed or otherwise directly measured to obtain a quantitative or numerical measurement. While the qualitative load size may not correlate with a direct numerical measurement of the weight or volume of the fabric load, an estimated or empirical weight or weight range may be associated to the qualitative load size (e.g., a small load size may be described as a 1-5 pound load size).

The method 100 may be adapted for determining more or less than three qualitative load sizes comprising the six load sizes extra small, small, first medium, second medium, large, and extra large, and, similarly, setting more or less than the corresponding number of operational water levels. In one example, the amount of water supplied to reach the reference water level A may be compared to more than two predetermined water amounts, which may enable more load sizes and operational water levels. Further, water may be supplied to additional levels above the water level D, and the water levels may be closer together for greater resolution, which may also enable more load sizes and operational water levels. As an example, water levels E and F and corresponding water amounts A-E and A-F may be used to determine additional load sizes and operational water levels.

The method 100 may be adapted for use with different washing machines. Various aspects, such as the number of load sizes and operational water levels, may depend on the configuration of the washing machine 10 and the external water supply. The method 100 may also be combined with a flow meter, flow restrictor, alternate fill method, and/or inputs by the user, such as fabric type.

The above description and the figures refer to the supply of water to the tub 14. The water may be water alone or water in combination with an additive, such as a wash aid, including, but not limited to a detergent, a bleach, an oxidizer, a fabric softener, etc. Any additive supplied to the tub 14, either through a detergent dispenser or manually added directly into the basket 18 or the tub 14, may affect the output of the water level sensor 54, and the method 100 may be adapted to account for such effects.

While the invention has been specifically described in connection with certain specific embodiments thereof, it is to be understood that this is by way of illustration and not of limitation, and the scope of the appended claims should be construed as broadly as the prior art will permit.

What is claimed is:

1. An automatic clothes washer, comprising:

an imperforate tub with a sump having a bottom surface;

a perforated drum located within the tub and having a bottom surface, the drum defining a laundry chamber for receiving a laundry load;

a water level sensor in the form of a pressure sensor having an inlet above the bottom surface of the sump for detecting a water level in the tub;

a water supply system configured to supply water into the tub; and a controller operably coupled to the water level sensor and the water supply system and configured to execute a load size determination by controlling the operation of the water supply system to supply water to a reference water level in the tub to define a first amount of water with the reference water level being at or above the inlet to the pressure sensor and to supply water to the tub from the reference water level to a second water level above the reference water level and sufficient to submerge the laundry load to define a second amount of water, and determining a load size for the laundry load based on the second amount of water wherein potential water amount errors associated with the supply of the first amount of water are not considered in the load size determination based on the second amount of water.

2. The automatic clothes washer according to claim 1 wherein the water supply system comprises a spraying system for spraying water into the tub.

3. The automatic clothes washer according to claim 2 wherein the drum is cylindrical with an open top and the spraying system comprises at least one nozzle configured to spray water into the open top.

4. The automatic clothes washer according to claim 3, further comprising a selectively controllable agitator located within the drum and operably coupled to the controller.

* * * * *